United States Patent [19]

Fraser

[11] Patent Number: 4,459,571

[45] Date of Patent: Jul. 10, 1984

[54] VARACTOR-TUNED HELICAL RESONATOR FILTER

[75] Inventor: Robert J. Fraser, Toronto, Canada

[73] Assignee: Motorola, Inc., Schaumburg, Ill.

[21] Appl. No.: 450,935

[22] Filed: Dec. 20, 1982

[51] Int. Cl.[3] ..... H01P 1/201; H01P 1/205

[52] U.S. Cl. ..... 333/202; 333/207; 333/212; 333/219; 333/235

[58] Field of Search ..... 333/175–176, 333/202–212, 219–235, 245–248; 334/15, 41, 78, 85; 307/320

[56] References Cited

U.S. PATENT DOCUMENTS

| | | | |
|---|---|---|---|
| 3,246,266 | 4/1966 | Racy | 333/231 |
| 3,337,791 | 8/1967 | Barton et al. | 334/41 X |
| 3,508,177 | 4/1970 | Suzuki | 334/15 |
| 3,703,689 | 11/1972 | McAtee | 333/207 X |
| 3,818,389 | 6/1974 | Fisher | 333/203 |
| 3,895,325 | 7/1975 | Fischer et al. | 334/15 X |
| 3,936,776 | 2/1976 | Sundquist | 333/206 X |

*Primary Examiner*—Marvin L. Nussbaum

*Attorney, Agent, or Firm*—Donald B. Southard; Edward M. Roney; James W. Gillman

[57] ABSTRACT

A helical cavity resonator filter utilizes varactor tuning diodes positioned within each helical resonator coil. The diodes are positioned along the longitudinal axes of the coils so as not to interfere with the non-axial electromagnetic fields of the cavities associated with each helical resonator coil.

3 Claims, 3 Drawing Figures

VARACTOR-TUNED HELICAL RESONATOR FILTER

FIELD OF INVENTION

This invention relates to a helical resonator filter and, more particularly, to an improved helical resonator filter that utilizes high quality varactor tuning diodes.

BACKGROUND OF THE INVENTION

The usual form of a helical resonator filter consists of several helical coils, each wound in the form of a helix, a conductive shell or housing having cavities, each cavity separated by a separating wall from the adjacent cavity and each cavity having a helical coil. The separating wall is apertured to provide an electromagnetic coupling between adjacent helical coils. An inherent characteristic of a conventional helical resonator is that the bandwidth of the filter is determined primarily by the size of the aperture in combination with the input and output coupling to the filter. In other words, the bandwidth that can be provided by the helical resonator filter is set by the geometry of the elements that constitute the resonator.

For tuning the filter, a metal tuning screw is provided into each of the cavities to adjust the capacitive or electrical field of the helical coils. Hence, the tuning of the helical resonator filter is solely a mechanical operation.

While the mechanical tuning operation is acceptable in many applications, it has certain inherent limitations imposed on the filter due to the mechanical nature of the tuning operation. Thus, for example, the tuning bandwidth is essentially defined and limited by physical dimensions of the cavities, helix and size of tuning screw. As a result, the conventional prior art resonator is not capable of shifting the tuned frequencies over a broad spectrum of frequencies.

SUMMARY OF THE INVENTION

It is an object of the invention to provide an improved helical resonator filter.

It is yet another object of the present invention to provide an increased tuning bandwidth of a helical resonator filter.

It is a further object of the present invention to provide a helical resonator filter that is capable of shifting its tuned frequencies over a wide range, such as UHF and VHF range of frequencies by using high quality varactor tuning diodes made of semiconductor materials that make it possible to tune the filter electrically with a response time in the nanosecond range.

The foregoing objects of the present invention are obtained in accordance with the present invention by providing a feedthrough capacitor for each of the cavities positioned through the conductive wall separating the cavity from the exterior thereof; a varactor positioned within the helical coil in each cavity along the longitudinal axis thereof so as not to interere with the non-axial electromagnetic fields in the cavity where the varactor has two conductive leads, one lead connecting the varactor to the feedthrough capacitor and the other lead connecting the feedthrough capacitor to a tapping point on the helical coil within the cavity; and biasing means for applying different biasing voltages to the varactors through the respective feedthrough capacitors, for electrically tuning the filter to different resonant frequencies.

The foregoing and other objects and features of the present invention will be more clearly understood from a detailed description of an illustrative embodiment of the present invention in conjunction with the accompanying drawing.

DETAILED DESCRIPTION

Figure 1:
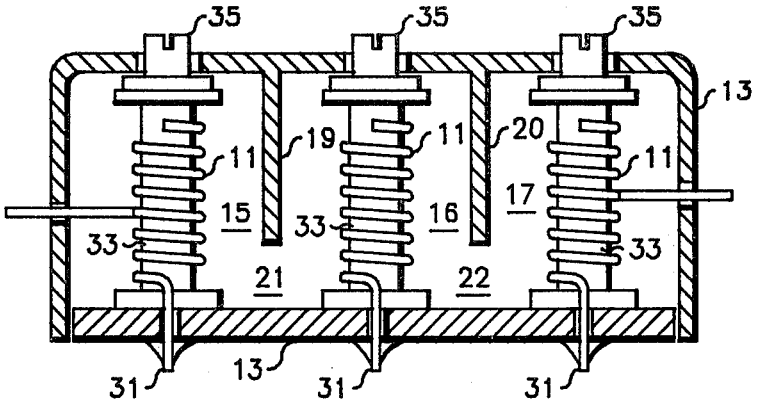
PRIOR ART Fig. 1
FIG. 1 shows a cut-away side view of a known conventional helical resonator filter with portions of the housing broken away.

Referring to FIG. 1, according to the prior art, a helical resonator filter includes two or more helical coils 11. The resonator filter also includes a conductive housing or shell 13 with a plurality o cavities 15, 16 and 17. The cavities may be in a rectangular or cylindrical shape, and each of the cavities is separated by conductive separating walls 19 and 20 which separate adjacent coils. The separating walls include apertures 21 and 22 which provide electromagnetic coupling between the adjacent helical coils. One end 31 of each of the helical coils is fixedly and conductively attached to the conductive shell 13 and thus becomes grounded as the conductive shell itself is used as the grounding plane in the application.

The bandwidth of the helical resonator filter of the prior art is determined by the size of the cavities, the helical coil and the aperture size. The larger the aperture between the adjacent coils is, the higher the coupling therebetween becomes. Also, the maximum bandwidth of the resonator filter is limited by the size of the cavities, the coil and apertures. Accordingly, the maximum bandwidth that can be attained by a helical resonator filter is very much fixed by the physical size and placement of the component elements. Furthermore, once the bandwidth is fixed, it stays fixed and cannot be shifted. For fine-tuning purposes, a metallic tuning screw 35 is axially positioned inside the helix near the ungrounded end. In short, the tuning frequency of the conventional helical resonator filter is limited to the mechanical operation of the tuning screw.

Figure 2:
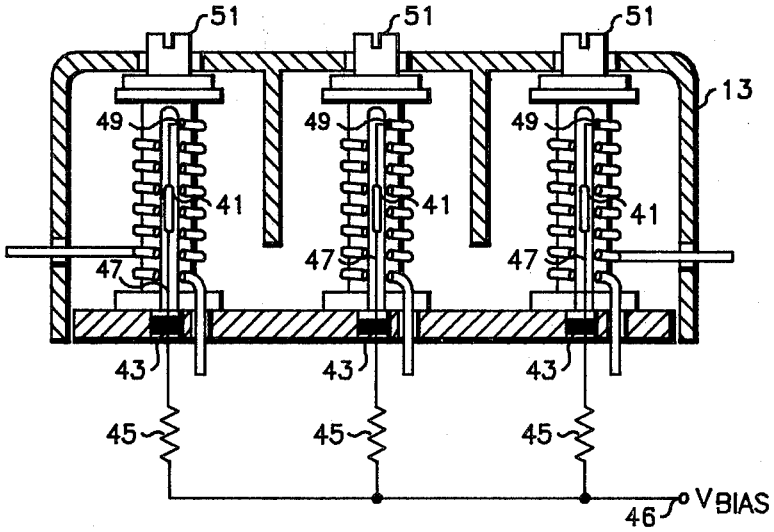
FIG. 2 shows an illustrative embodiment of the present inventive helical resonator with varactors, feedthrough capacitors and biasing means.

FIG. 2 shows an illustrative embodiment of the present invention where the mechanical limitation of the tuning screw is avoided. Instead, high quality varactors, feedthrough capacitors and biasing means are used to provide tuning function where tuned frequencies can be shifted by having the biasing means apply different bias voltages to the varactors through the feedthrough capacitors.

Referring more specifically to FIG. 2, there is provided in each cavity of the filter a high quality varactor 41 that displays high Q and very low capacitance, such as Galsium Arsenide hyper abrupt tuning diode. The varactor is positioned along the longitudinal axis of the coil so as not to interfere with the non-axial electromagnetic fields in the cavity.

The filter also includes a feedthrough capacitor 43 for each of the cavities, a biasing resistor 45 connected to each of the feedthrough capacitors, and a bias potential source 46, $V_{bias}$, for biasing the varactors through the respective V resistors and feedthrough capacitors.

The proper physical placement of the varactors in the resonator cavities is very important. The varactor leads 47 must be electrically attached to the helical coils and the feedthrough capacitors. The feedthrough capacitor must be of the type that provides r.f. ground and DC path from the biasing resistors to the varactors.

The varactors 41 and the leads 47 should be positioned along the longitudinal axis of the coils, as illustrated, so that they don't interfere with the non-axial electromagnetic fields in the cavity.

As illustrated, all varactors may share a common bias voltage source 46 applied thereto through respective resistors 45 and feedthrough capacitors 43. Alternatively each varactor may be biased separately, although separate bias may require a rather complex biasing control network. The feedthrough capacitors are r.f. grounded to the conductive housing 13 and provide DC bias voltage from the bias source to each of the varactors. For fine tuning, the tuning screws 51 are provided, as illustrated. If it were possible to construct the filters easily exactly to a predetermined dimension, the tuning screws could be eliminated, and the designer has the option of biasing each of the varactors, through a feedthrough capacitor placed at the top of the cavity in place of the corresponding tuning screw, as shown.

A filter was built embodying the principles of the present invention as specifically set forth below.

Figure 3:
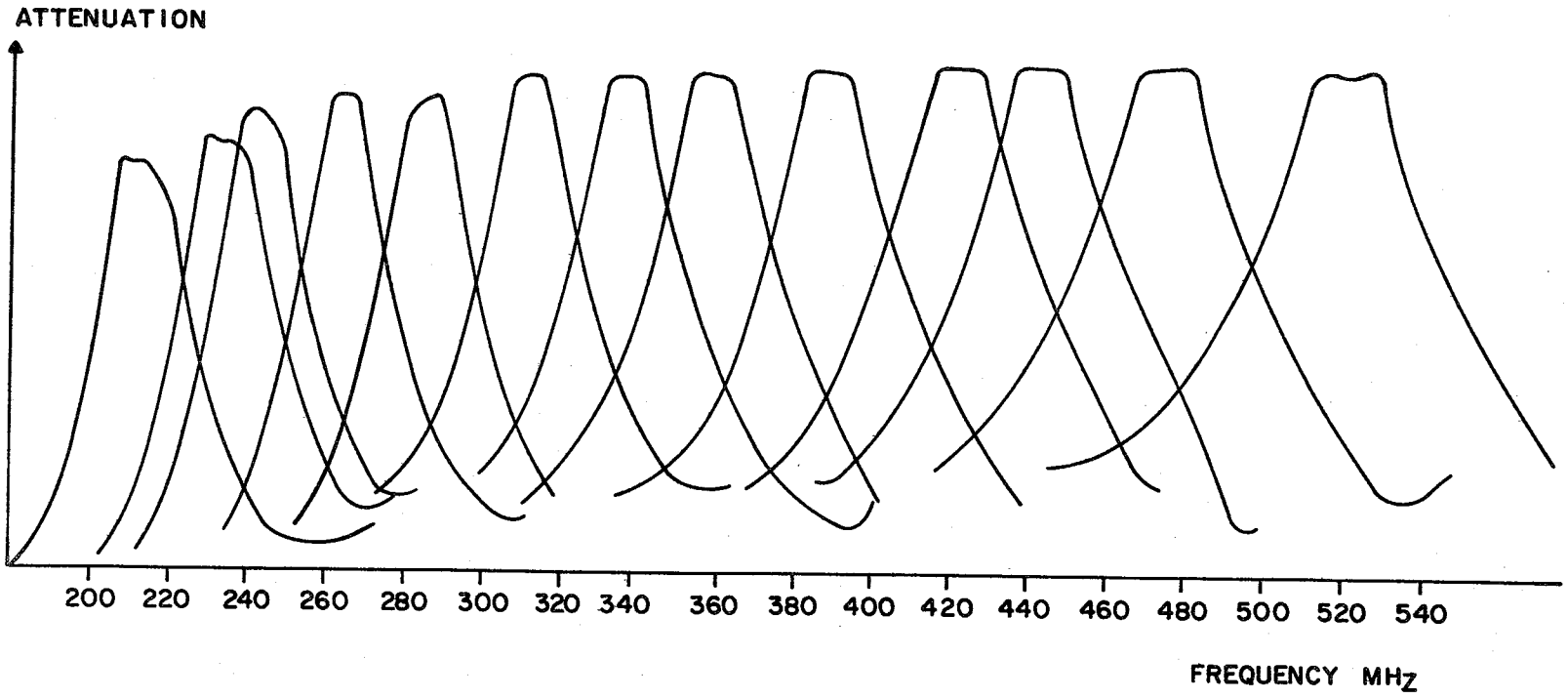
FIG. 3 is a frequency response characteristic of the inventive helical filter which shows different tuned frequency characteristics for different biasing voltage applied to the varactors.

Cavity Width = 10.5 mm
Cavity Height = 18.7 mm
Helix Outside Diameter = 7.3 mm
Number of Cavities = 3
Wire Gauge = 20; 6.0 turns of coil
Pitch of the Helix = 1.6 mm/turn
Resistors = 10,000 ohms each
Feedthrough Capacitors = 300 pfd. each
Varactor Diode = Ga As semiconductor high Q, very low capacitance The filter built according to the above specification produced tuned frequency response characteristics, as shown in successive curves in FIG. 3.

By applying different DC bias voltages to the varactor, the tuned frequency is readily shifted, as illustrated in FIG. 3. As illustrated, by changing the bias voltage, the tuned frequencies are changed over a wide range of frequencies. Thus, for example, by changing the DC bias voltage from 0 to 30 volts, it was found possible to change the tuned frequency from 210 to 520 MHz for a helical filter built according to the present invention.

Various modifications and changes may be made without departing from the spirit and scope of the present invention.

What is claimed is:

1. A helical resonator filter comprising:

a plurality of conductive helical coils, a conductive shell having a plurality of cavities, each cavity housing one of said helical coils and separated by conductive walls, the wall between adjacent cavities having an aperture for providing electromagnetic coupling between adjacent helical coils;

a feedthrough capacitor provided for each of said cavities and positioned through said conductive shell in the axis of said helical coil separating the cavity from exterior thereof;

a varactor positioned within the helical coil in each cavity along the longitudinal axis thereof so as not to interfere with the non-axial electromagnetic fields in the cavity, said varactor having two conductive leads, one lead connecting said varactor to said feedthrough capacitor and the other lead connecting said feedthrough capacitor to a tapping point on the helical coil within the cavity, and biasing means for applying different biasing voltages to said varactors through to said respective feedthrough capacitors, for electrically tuning said filter to different resonant frequencies.

2. The helical resonator filter according to claim 1, wherein said biasing means includes a resistor connecting each of said feedthrough capacitors to a common bias voltage source.

3. The helical resonator filter according to claim 1, a tuning screw for each of said cavities disposed through the cavity wall and aligned with the corresponding helical coil for fine tuning said filter.

* * * * *